US007702258B2

(12) United States Patent
Kim et al.

(10) Patent No.: US 7,702,258 B2
(45) Date of Patent: Apr. 20, 2010

(54) COLOR IMAGE FORMING APPARATUS WITH COLOR REGISTRATION COMPENSATION UNIT

(75) Inventors: Soo-yong Kim, Seoul (KR); Byeong-hwa Ahn, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 565 days.

(21) Appl. No.: 11/352,991

(22) Filed: Feb. 14, 2006

(65) Prior Publication Data

US 2007/0077090 A1 Apr. 5, 2007

(30) Foreign Application Priority Data

Oct. 5, 2005 (KR) ..... 10-2005-0093492

(51) Int. Cl.
*G03G 15/00* (2006.01)

(52) U.S. Cl. ..... 399/167; 399/301

(58) Field of Classification Search ..... 399/167, 399/298, 299

See application file for complete search history.

(56) References Cited

U.S. PATENT DOCUMENTS 5,386,286 A * 1/1995 Kinouchi et al. ..... 399/228
5,960,237 A * 9/1999 Toyoshi et al. ..... 399/226
2002/0114642 A1* 8/2002 Rimai et al. ..... 399/167
2003/0190172 A1* 10/2003 Makino ..... 399/167
2006/0104666 A1* 5/2006 Yoon ..... 399/228

FOREIGN PATENT DOCUMENTS

| | | |
|---|---|---|
| JP | 04-245261 | 9/1992 |
| JP | 2001-154560 | 6/2001 |
| JP | 2003-076217 | 3/2003 |
| KR | 1999-015277 | 3/1999 |

* cited by examiner

*Primary Examiner*—Quana M Grainger
(74) *Attorney, Agent, or Firm*—Roylance, Abrams, Berdo & Goodman, L.L.P.

(57) ABSTRACT

A tandem color image forming apparatus includes a plurality of photosensitive bodies driven by one driving source and having a shaft gear, and power transmission members engaged with the shaft gears of the plurality of the photosensitive bodies to transmit a driving force generated from the driving source to each of the plurality of the photosensitive bodies. At least one color registration compensation unit is disposed between the power transmission members. The color image forming apparatus employs the color registration compensation unit so that each photosensitive body can be synchronized and registration errors can be minimized.

21 Claims, 10 Drawing Sheets

COLOR IMAGE FORMING APPARATUS WITH COLOR REGISTRATION COMPENSATION UNIT

CROSS-REFERENCE TO RELATED APPLICATIONS

This application claims the benefit under 35 U.S.C. §119(a) of Korean Patent Application No. 2005-93492, filed on Oct. 5, 2005, the entire contents of which are hereby incorporated by reference.

BACKGROUND OF THE INVENTION

1. Field of the Invention

The present invention relates to a color image forming apparatus. More particularly, the present invention relates to a color image forming apparatus that can synchronize each photosensitive body in the apparatus so as to compensate for color registration errors.

2. Description of the Related Art

An image forming apparatus (such as a color laser beam printer or a color copier) generally employs a tandem structure which emits a laser beam onto photosensitive bodies arranged by color to form separate color images. The separate color images are then overlaid upon one another to form a full-color image on a paper, either directly or through a transfer belt. FIG. 1 is an illustration of a typical tandem image forming apparatus.

As shown in FIG. 1, a color image forming apparatus 1 comprises a plurality of image forming units 10Y, 10M, 10C, 10K having a plurality of photosensitive bodies 11Y, 11M, 11C, 11K and a plurality of developing devices 12Y, 12M, 12C, 12K, a transfer unit 30 opposed to the plurality of photosensitive bodies 11Y, 11M, 11C, 11K, and a fixing device 40. In the image forming unit, if the plurality of photosensitive bodies 11Y, 11M, 11C, 11K are driven in the direction indicated by the arrows, the surface of the photosensitive bodies 11Y, 11M, 11C, 11K is charged by chargers 15Y, 15M, 15C, 15K and a laser beam L is emitted from a laser scanning unit (not shown) so as to form an electrostatic latent image of an image to be developed with a first color. For example, if a yellow Y color image is developed, the yellow developing roller 13Y develops the electrostatic latent image formed on the photosensitive body 11Y with yellow toner to form a toner image. The yellow image is transferred through a transfer roller 32Y of the transfer unit onto a paper S fed by a transfer belt 31. Likewise, magenta (M), cyan (C) and black (K) images are formed and transferred to finally form a full-color image on the paper S. The fixing device 40 fixes the toner image transferred on the paper S by heating and pressing the toner image so that it is completely fixed onto the paper S. The color image forming apparatus 1 also includes toner supply rollers 14Y, 14M, 14C, 14K, driven rollers 33*a*, 33*b*, and 33*c*, tension roller 34, and a transfer belt cleaning unit 35.

In the color image forming apparatus 1, it is important to accurately conform each color toner image to the plurality of photosensitive bodies 11Y, 11M, 11C, 11K so that the final image is properly registered. To this end, the conventional image forming apparatus 1 operates the plurality of photosensitive bodies 11Y, 11M, 11C, 11K using one driving source, and synchronizes the photosensitive bodies based on the initial positions of the bodies.

FIG. 2 is a perspective view showing more details of the structure of the plurality of photosensitive bodies of a conventional image forming apparatus. As shown in FIG. 2, a driving source 50 generates a driving force and transmits the force through a plurality of power transmitting members 20Y, 20M, 20C, 20K and a plurality of idle gears 23M, 23C, 23K to the plurality of photosensitive bodies 11Y, 11M, 11C, 11K. The plurality of photosensitive bodies 11Y, 11M, 11C, 11K are mounted on shafts, and the shafts are mounted on a main body supporting frame (refer to "F" of FIG. 5). The plurality of power transmitting members 20Y, 20M, 20C, 20K comprise retardation gear members 21Y, 21M, 21C, 21K and transmitting gear members 22Y, 22M, 22C, 22K. The first retardation gear member 21K of the first power transmitting member 20K is meshed with a driving gear 51 of the driving source, and the first transmitting gear member 22K of the first power transmitting member 20K is meshed with a shaft gear 16K of the first photosensitive body 11K. Accordingly, if the driving source 50 is driven, the driving force is transmitted through the first power transmitting member 20K so as to rotate the first photosensitive body 11K. The first, second, and third idle roller gears 23K, 23C, 23M are disposed between the second, the third, and the fourth power transmitting members 20C, 20M, 20Y. The driving force of the driving source 50 is transmitted through the second, third, fourth power transmitting members 20C, 20M, 20Y to the second, third, and fourth photosensitive bodies 11C, 11M, 11Y so as to rotate the second, the third, and the fourth photosensitive bodies 11C, 11M, 11Y together in the same direction.

The color image forming apparatus 1, in which a plurality of photosensitive bodies are together driven by one single driving source, is designed by assuming that the feeding speed of the paper S is regular and that the entrance signal timing of a leading end of the paper S for each color calculated from an initial signal is theoretically the same.

FIGS. 3A and 3B illustrate the operation of the photosensitive bodies of the color image forming apparatus. For convenience, FIGS. 3A and 3B depict only two photosensitive bodies 11Y, 11M. Referring to FIG. 3, if the paper S is fed to the third photosensitive body 11M driven in association with the fourth photosensitive body 11Y via the fourth power transmitting member 20Y (refer to FIG. 3B), after the paper S is fed to the fourth photosensitive body 11Y (refer to FIG. 3A), the third photosensitive body 11M should have the same phase as the fourth photosensitive body 11Y as indicated by the arrows in FIG. 3B. However, the speed is changed by minute amounts due to various issues with the image forming apparatus so that registration errors occur. One of the largest issues is that the linear velocity changes due to gear run-out. The changing linear velocity produces a different interval for each color image. FIG. 4 is a graph showing the misregistration of two color images caused by a change in linear velocity.

As shown in FIG. 4, as each photosensitive body is driven by the driving source, the linear velocity varies due to gear run-out. Additionally, the difference between each photosensitive body and the laser scanning unit, which scans with a certain speed, results in a periodic change on the paper. It is difficult to completely, mechanically remove these changes. As mechanical accuracy increases, higher costs are incurred. A color image forming apparatus should compensate for color registration errors based on the cycle of the rotation speed of the photosensitive body to increase image quality. A color image forming apparatus, in which a separate driving source is connected to separate, modularized image forming units to transmit a separate driving force to each of the plurality of photosensitive bodies, can synchronize the plurality of photosensitive bodies by a simple computer program to prevent the phase difference of each driving source. However, a color image forming apparatus, in which a plurality of photosensitive bodies are driven by one driving source, can not easily prevent registration errors.

Accordingly, there is a need for an improved apparatus for driving photosensitive bodies in a tandem image forming apparatus to prevent registration errors.

SUMMARY OF THE INVENTION

An aspect of the present invention is to address at least the above problems and/or disadvantages and to provide at least the advantages described below. Accordingly, an aspect of the present invention is to provide a color image forming apparatus which has a color registration compensation unit at some or all of a plurality of photosensitive bodies so that the linear velocity of each photosensitive body of a plurality of photosensitive bodies can be synchronized to minimize registration errors.

In accordance with an exemplary embodiment of the present invention, a color image forming apparatus comprises a plurality of photosensitive bodies driven by one driving source. Each of the plurality of photosensitive bodies has a shaft gear, and a plurality of power transmission members are engaged with the shaft gears of the plurality of the photosensitive bodies to transmit a driving force generated from the driving source to each of the plurality of the photosensitive bodies. At least one color registration compensation unit is disposed between the plurality of power transmission members.

The power transmission member may comprise a retardation gear member having a greater diameter than a driving gear of the driving source, and a transmission gear member coaxially engaged with the retardation gear member to transmit the driving force to each of the plurality of photosensitive bodies.

The color registration compensation unit may comprise an elastic member and a cam member. The elastic member has a first end and a second end. The first end of the elastic member is disposed on a supporting frame and the second end is disposed on an idle roller gear. The cam member contacts the idle roller gear to move the idle roller gear in an axial direction of the photosensitive body.

The apparatus may further comprise a transfer unit opposed to the plurality of photosensitive bodies. The transfer unit may comprise a plurality of transfer rollers arranged to oppose each of the plurality of photosensitive bodies, and a transfer conveying belt passing between the plurality of the transfer rollers and the plurality of photosensitive bodies. As a paper passes between the plurality of photosensitive bodies and the transfer unit, toner images formed on the plurality of the photosensitive bodes are directly transferred onto the paper.

The transfer unit may comprise a plurality of intermediate transfer rollers arranged to oppose each of the plurality of photosensitive bodies, an intermediate transfer belt passing between the plurality of the intermediate transfer rollers and the plurality of photosensitive bodies, and a transfer roller transferring toner images from the intermediate transfer belt onto the paper.

The driving gear of the one driving source may be meshed with one power transmission member so as to transmit the driving force to the plurality of the photosensitive bodies.

In accordance with another exemplary embodiment of the present invention, a color image forming apparatus comprises a plurality of photosensitive bodies driven by one driving source, each of the plurality of photosensitive bodies having a shaft gear, and a plurality of power transmission members engaged with the shaft gears of the plurality of photosensitive bodies to transmit a driving force generated from the driving source to each of the plurality of photosensitive bodies. A color registration compensation unit is formed on at least one of the power transmission members.

A driving gear of the one driving source may be meshed with two neighboring power transmission members to transmit the driving force to the plurality of photosensitive bodies.

The power transmission member may comprise a retardation gear member having a greater diameter than a driving gear of the driving source, and a transmission gear member coaxially engaged with the retardation gear member to transmit the driving force to each of the plurality of photosensitive bodies.

The power transmission member may further comprise an idle roller gear disposed between non-neighboring retardation gear members, to be meshed with each other.

The neighboring retardation gear members may overlap each other.

The color registration compensation unit may comprise an elastic member and a cam member. The elastic member has a first end and a second end. The first end of the elastic member is disposed on a supporting frame and the second end is disposed on an idle roller gear. The cam member contacts the idle roller gear to move the idle roller gear in an axial direction of the photosensitive body.

The idle roller gear may also operate as an idle roller gear of the power transmission member.

In accordance with another exemplary embodiment of the present invention, a color image forming apparatus comprises a plurality of photosensitive bodies driven by at least two driving sources, each of the plurality of photosensitive bodies having a shaft gear, and a plurality of power transmission members engaged with the shaft gear of the plurality of photosensitive bodies to transmit a driving force generated from the driving sources to each of the plurality of photosensitive bodies. At least one color registration compensation unit may be disposed between the power transmission members.

The at least two driving sources may be synchronized and driven at the same speed.

The power transmission member may comprise a retardation gear member having a greater diameter than a driving gear of each of the driving sources, and a transmission gear member coaxially engaged with the retardation gear member to transmit the driving force to each of the plurality of photosensitive bodies.

The color registration compensation unit may comprise an elastic member with a first end and a second end, the first end of the elastic member being disposed on a supporting frame and the second end being disposed on an idle roller gear, and a cam member contacting the idle roller gear to move the idle roller gear in an axial direction of the photosensitive body.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
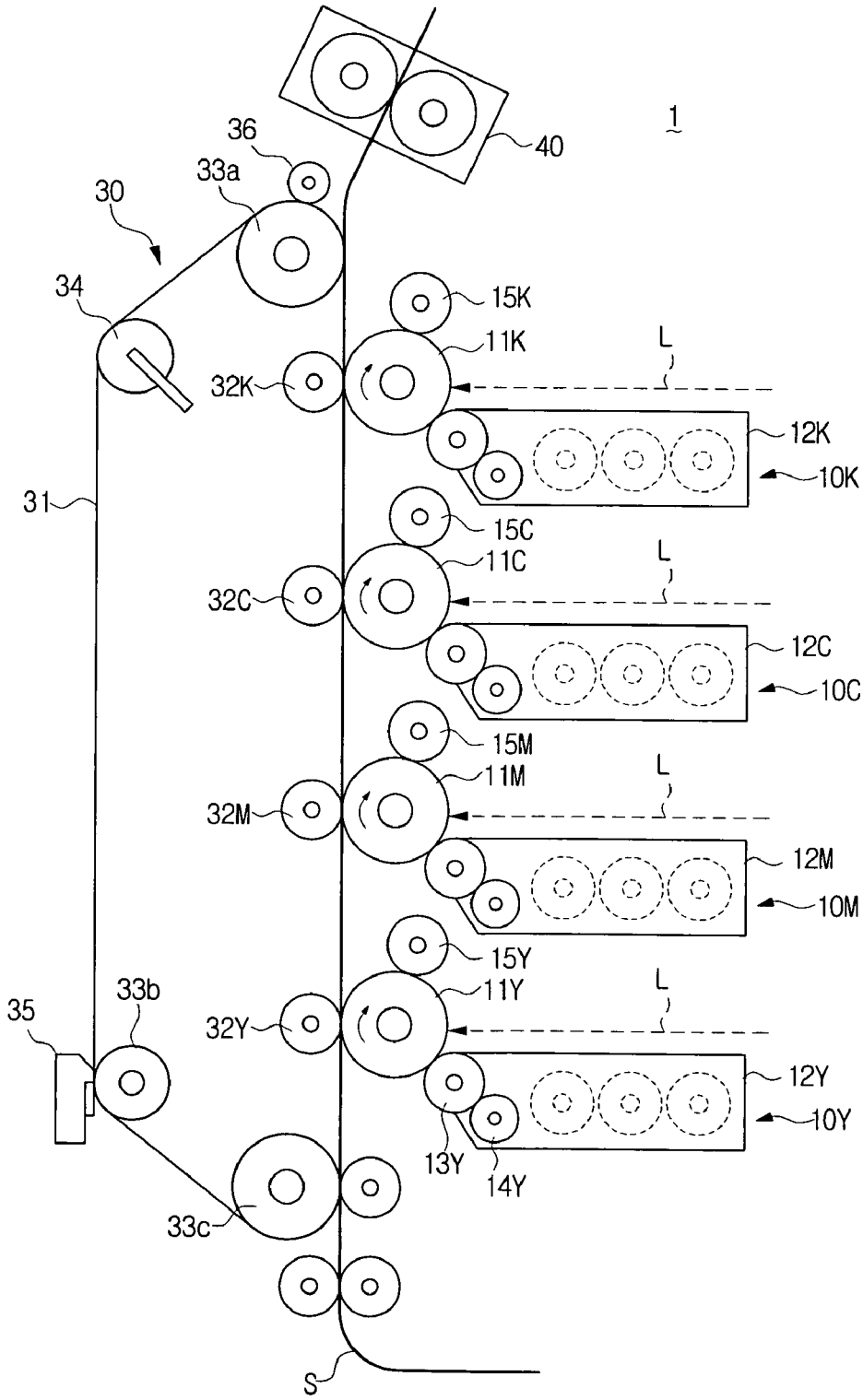
FIG. 1 (PRIOR ART)
FIG. 1 is a schematic view of a conventional color image forming apparatus.
Figure 2:
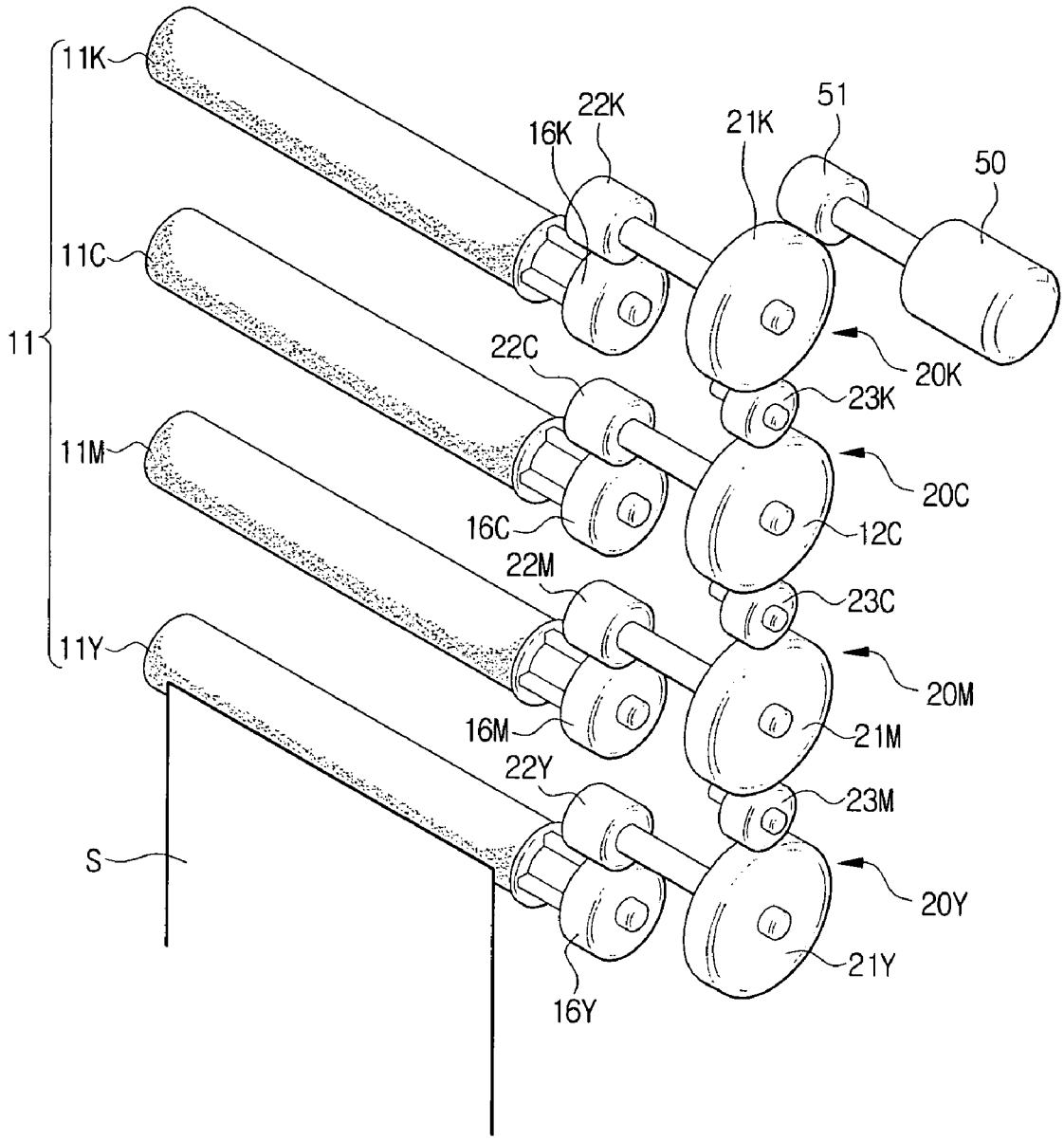
FIG. 2 (PRIOR ART)
FIG. 2 is a perspective view of a plurality of photosensitive bodies of the image forming apparatus of FIG. 1.
Figure 3A:
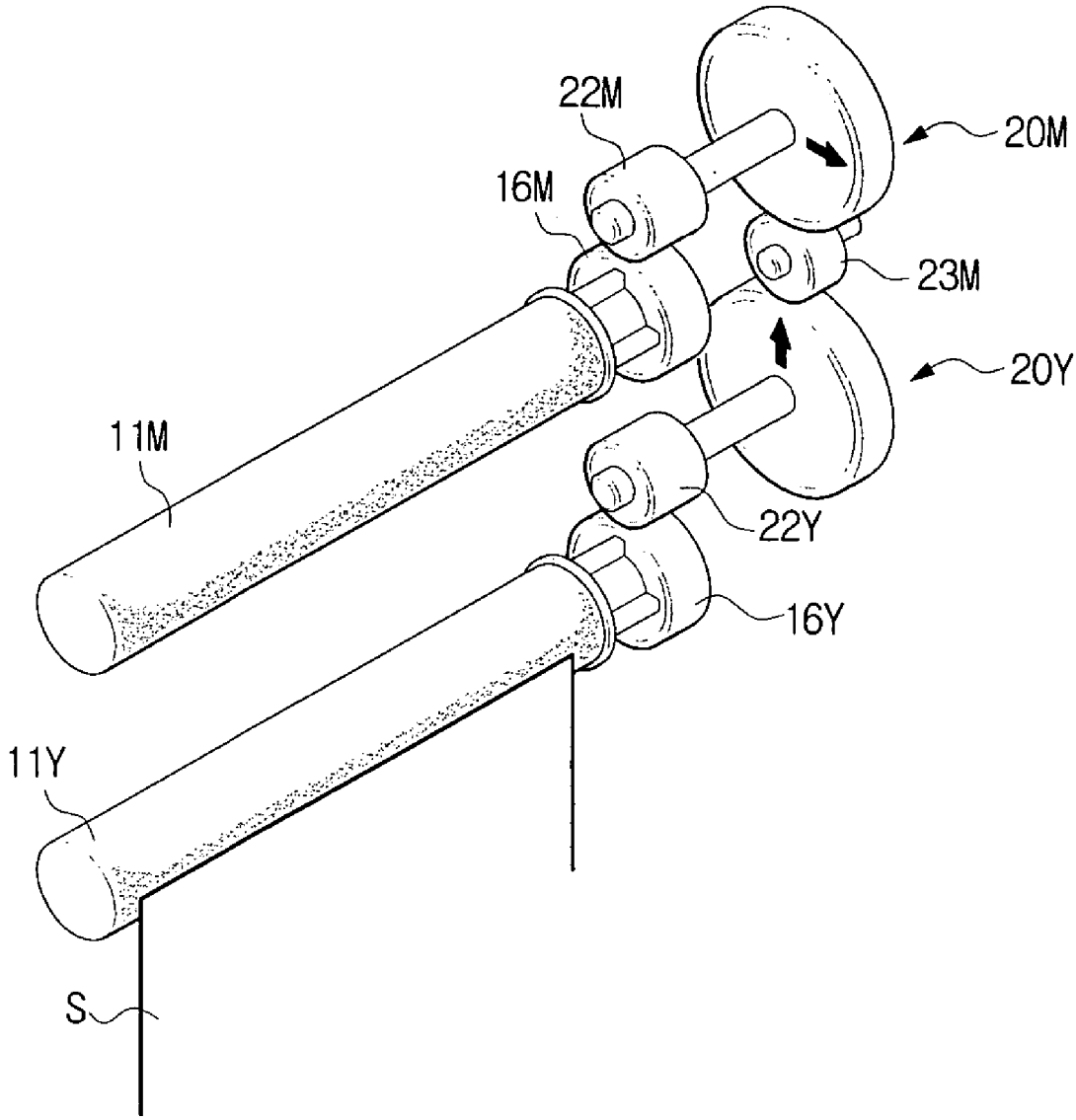
FIG. 3A (PRIOR ART)
FIGS. 3A and 3B are perspective views of a plurality of photosensitive bodies of FIG. 1 which illustrate the asynchronous nature of the plurality of photosensitive bodies of the color image forming apparatus of FIG. 1.
Figure 3B:
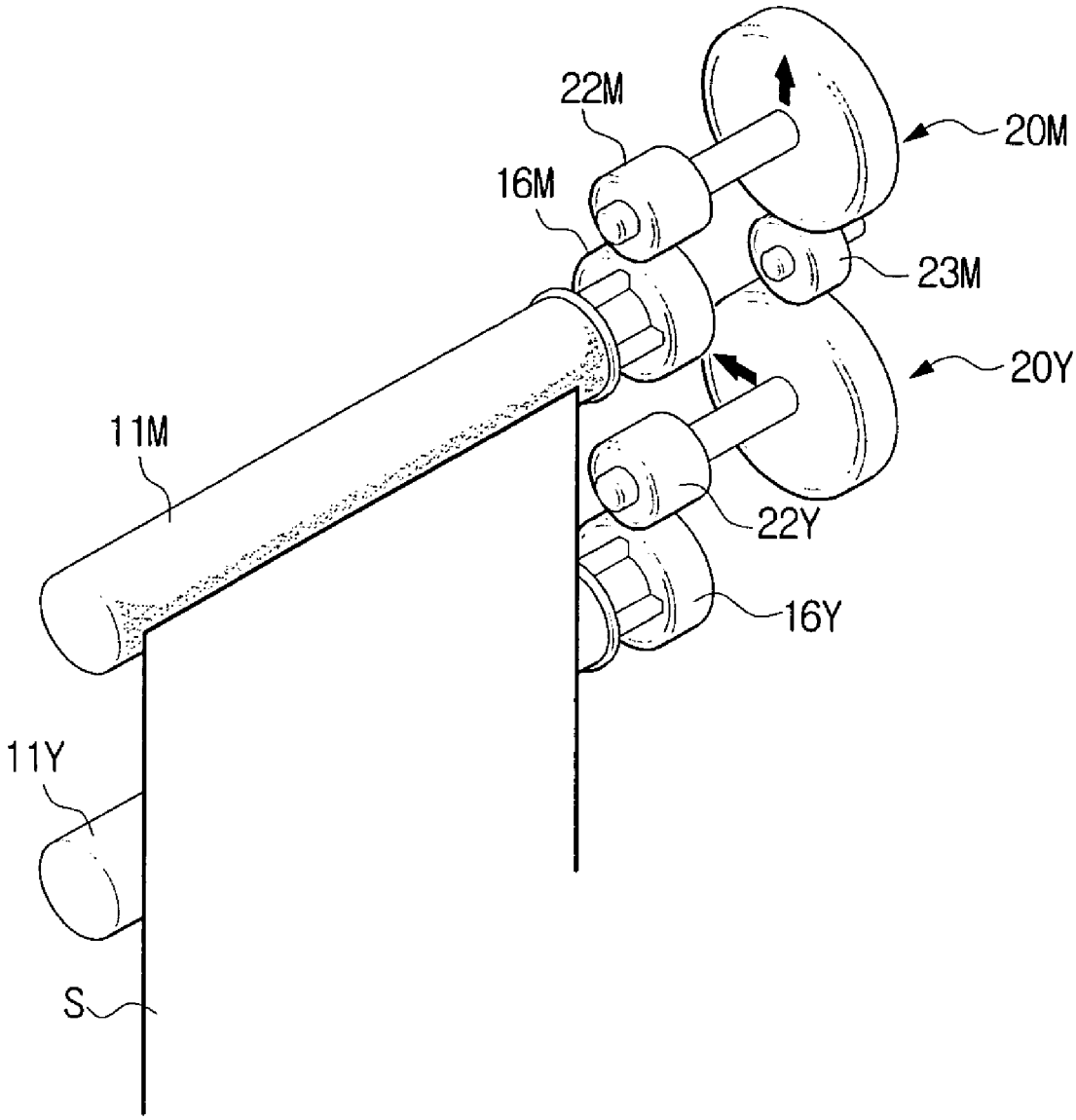
FIG. 3B (PRIOR ART)
Figure 4:
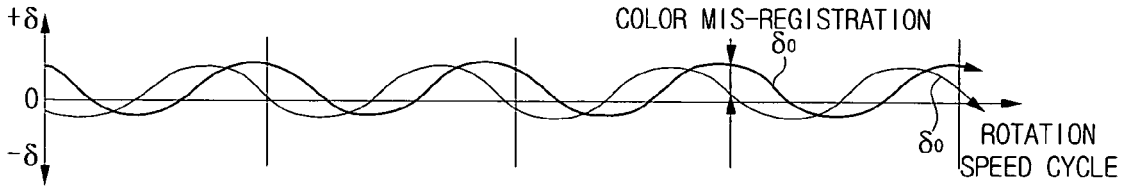
FIG. 4 (PRIOR ART)
FIG. 4 is a graph of the rotation speed cycle of the plurality of photosensitive bodies of FIG. 3.

A color image forming apparatus according to an exemplary embodiment of the present invention employs a tandem structure which uses an image forming unit with a plurality of photosensitive bodies and a developing device to synchronize the rotation speed of each of the plurality of photosensitive bodies and enhance color registration, which is an important factor for image quality. As shown in FIG. 1, a conventional tandem color image forming apparatus has a plurality of image forming units 10Y, 10M, 10C, 10K disposed on a main body frame. The image forming units form images of separate colors, and the separate color images are overlaid upon one another to form a full color image.

The plurality of image forming units 10Y, 10M, 10C, 10K may be cartridge-type consumable products which may be mounted by a consumer or a repairman. The image forming units are typically driven by one driving source.

In the color image forming apparatus, a plurality of photosensitive bodies 11Y, 11M, 11C, 11K correspond to the plurality of image forming units 10Y, 10M, 10C, 10K. A transfer unit 30 may be located opposite to the plurality of photosensitive bodies 11Y, 11M, 11C, and 11K. The transfer unit 30 comprises a plurality of transfer rollers 32Y, 32M, 32C, 32K arranged to correspond to each of the plurality of photosensitive bodies 11Y, 11M, 11C, 11K. A transfer conveying belt 31 passes between the plurality of transfer rollers and the plurality of photosensitive bodies. A paper S is passed between the plurality of photosensitive bodies 11Y, 11M, 11C, 11K and the transfer unit 30, and the toner images formed on the plurality of the photosensitive bodies are directly transferred onto the paper S.

A different style of transfer unit that uses an intermediate transfer belt may also be used. In that case, a plurality of intermediate transfer rollers (corresponding to 32Y, 32M, 32C, 32K of FIG. 1) are arranged opposite to the plurality of the photosensitive bodies 11Y, 11M, 11C, 11K, and an intermediate transfer belt (corresponding to 31 of FIG. 1) passes between the plurality of the intermediate transfer rollers and the plurality of the photosensitive bodies. A transfer roller (corresponding to 36 of FIG. 1) transfers the toner image from the intermediate transfer belt onto a paper S. Thus, in this type of image transfer unit, the toner images formed on the plurality of the photosensitive bodies 11Y, 11M, 11C, 11K, are transferred onto the intermediate transfer belt. The paper S passes between the intermediate transfer belt and the transfer roller 36, and the toner image on the transfer belt is transferred onto the paper S.

Figure 5:
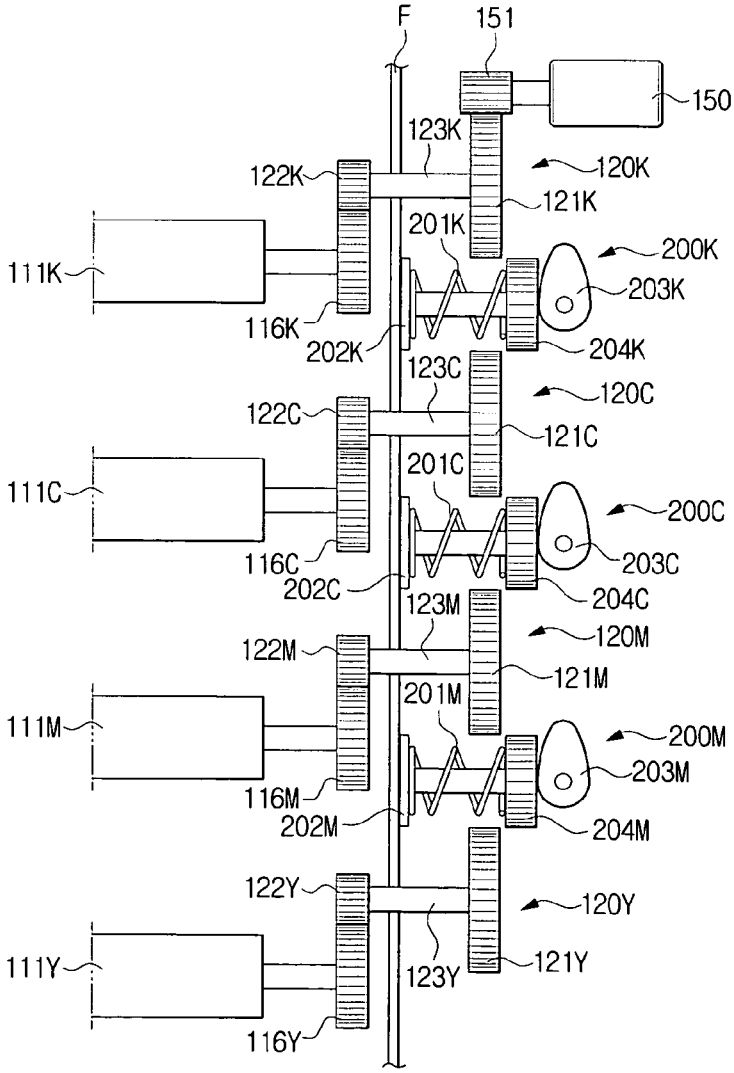
FIG. 5 is a front view of a portion of a color image forming apparatus according to a first exemplary embodiment of the present invention.

FIG. 5 is a view of a portion of a color image forming apparatus according to a first exemplary embodiment of the present invention, in which a color registration compensation unit is mounted on each side of the plurality of the photosensitive bodies. As shown in FIG. 5, the color image forming apparatus according to the first exemplary embodiment of the present invention comprises a plurality of photosensitive bodies 111Y, 111M, 111C, 111K, power transmission members 120Y, 120M, 120C, 120K and color registration compensation units 200. These components are arranged to correspond to different colors, such as yellow Y, magenta M, cyan C and black K, and basically have the same structures. Accordingly, for conciseness and to avoid repetition, only the first photosensitive body 111Y, the first power transmission member 120Y and the color registration compensation unit 200M will be described in detail.

A shaft gear 116Y is formed on the central axis of the first photosensitive body 111Y and engages the first transmission member 120Y. The first photosensitive body 111Y is driven by one driving source 150.

The first power transmission member 120Y comprises a first retardation gear member 121Y and a first transmission gear member 122Y. The first retardation gear member 121Y can reduce the frequency of rotation of a driving source 150 because its diameter is greater than that of a driving gear 151 of the driving source 150. The first transmission gear member 122Y is engaged with the first retardation gear member 121Y by a shaft 123Y, and transmits the driving force to the first photosensitive body 111Y.

The color registration compensation unit 200M comprises a first elastic member 201M and a first cam member 203M. The first elastic member has a first end and a second end. The first end of the first elastic member 201M is fixed on the supporting frame F, and the second end engages a first idle roller gear 204M. A washer 202M may be placed between the first end of the first elastic member and the supporting frame F. The first cam member 203M contacts the first idle roller gear 204M, and the first idle roller gear 204M can be moved in an axial direction of the first photosensitive body 111Y according to the rotation of the first cam member 203M.

The fourth retardation gear member 121K of the fourth power transmission member 120K is meshed with the driving gear 151 of the driving source 150. Therefore, the driving force generated from the driving source 150 is transmitted through the fourth power transmission member 120K to each of the plurality of photosensitive bodies 111Y, 111M, 111C, 111K.

In one type of conventional color image forming apparatus, a separate driving unit is mounted to each of the color image forming units so that each color image forming unit can be independently rotated and the plurality of photosensitive bodies can be synchronized. On the other hand, if one driving source is used to drive all of the color image forming units, manufacturing costs can be also reduced. However, errors (such as runout) in either the roller or gears of the color image forming apparatus may cause registration errors. The exemplary embodiments of the present invention employ at least one color registration compensation unit to compensate for registration errors that may occur when using one driving source.

The process of color registration compensation using the color registration compensation unit of the color image forming apparatus according to the first exemplary embodiment of the present invention will now be explained in detail with reference to accompanying drawings.

Figure 6A:
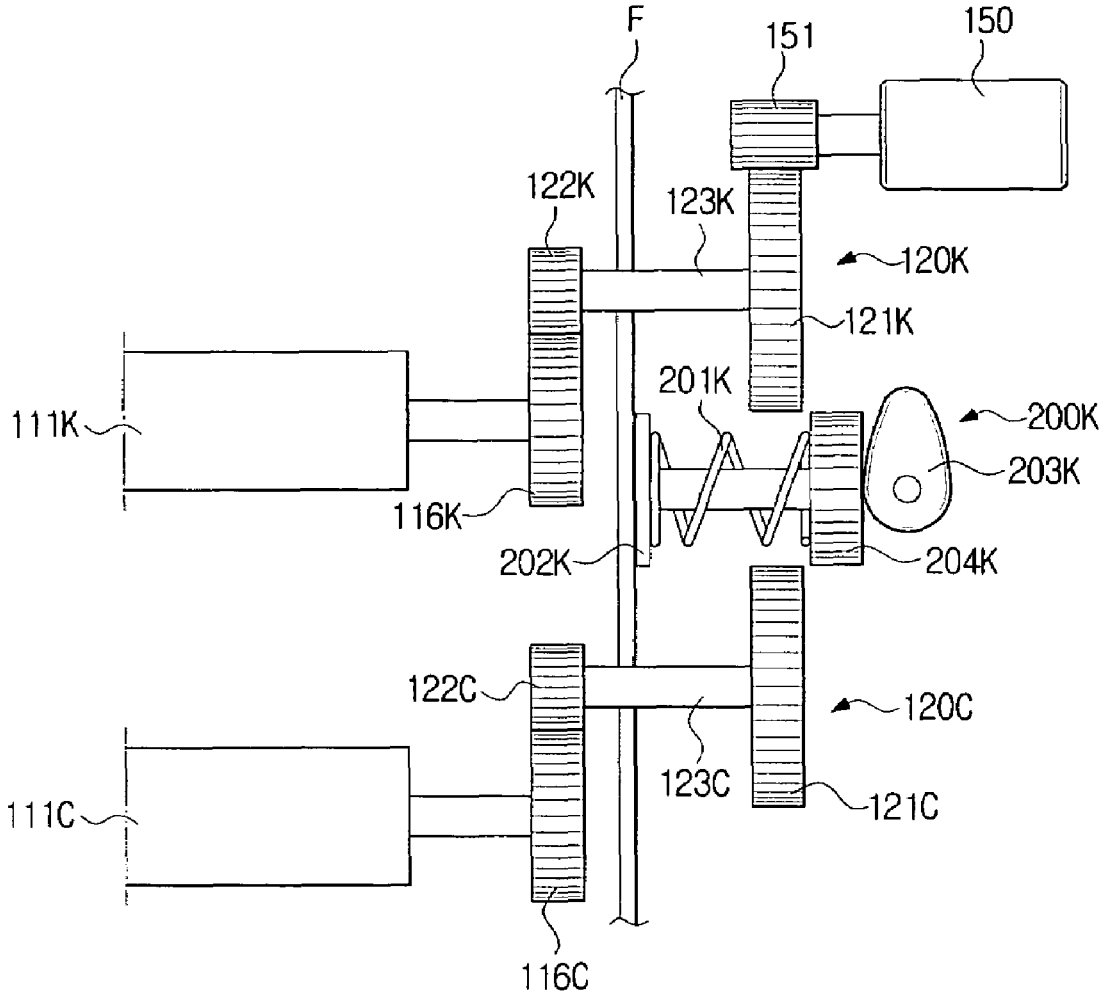
FIGS. 6A and 6B are front views of a color registration compensation unit of the color image forming apparatus of FIG. 5.
Figure 6B:
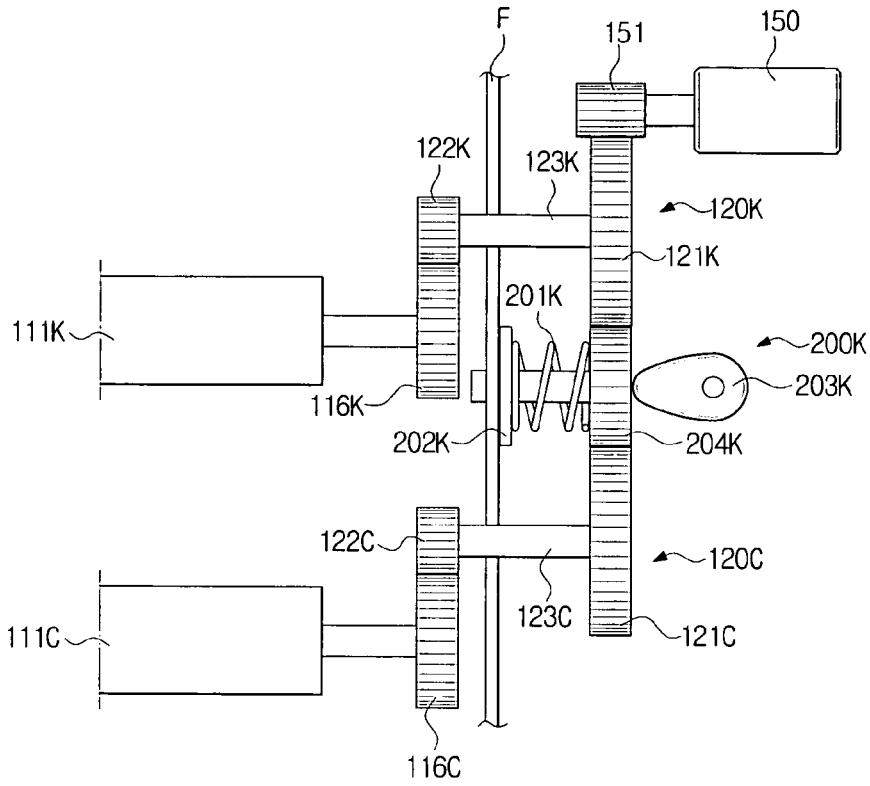

FIGS. 6A and 6B illustrate the operation of the color registration compensation unit of the color image forming apparatus according to the first exemplary embodiment of the present invention: FIGS. 6A and 6B show the status before and after the color registration compensation unit is operated, respectively. For convenience, the color registration compensation process only for the fourth photosensitive body 111K engaged with the driving source 150, and the third photosensitive body 111C operated in association with the fourth photosensitive body 111K will be shown in FIG. 6.

As the plurality of photosensitive bodies of the color image forming apparatus prints the toner image onto the paper, it is necessary to examine the cycle of minute speed changes generated by errors such as runout of each shaft gear of the plurality of photosensitive bodies. The peak position of either the maximum or minimum rotation speed of each of the plurality of photosensitive bodies is synchronized so that all the colors can be printed at the same printing position.

Figure 7:
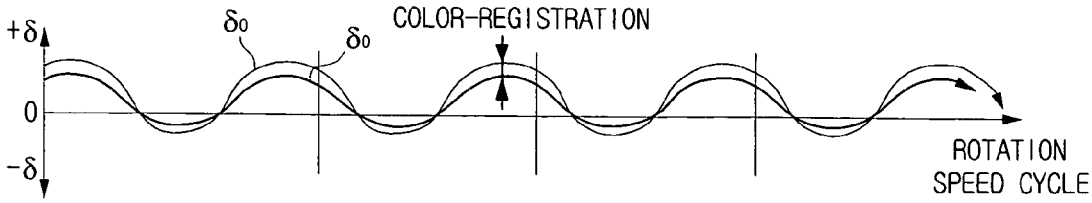
FIG. 7 is a graph of the rotation speed cycle of the plurality of photosensitive bodies of FIG. 5.

As shown in FIG. 6, the fourth photosensitive body 111K (nearest to the driving source 150) can be rotated by the driving source 150, and the third photosensitive body 111C (farthest from the driving source 150) can be stopped by releasing the idle roller gear 204. Therefore, if the peak position of the cycle of the fourth photosensitive body 111K corresponding to black K is examined and then the peak position of the third photosensitive body 111C corresponding to cyan C is moved so that the color registration can be compensated, the rotation speed cycle of the fourth photosensitive body 111K is conformed with the rotation speed cycle, that is, phase, of the third photosensitive body 111C as the third photosensitive body 111C is stopped. As shown in FIG. 6A, if the cam member 203K of the color registration compensation unit 200K is rotated, the idle roller gear 204K is moved toward the right by the elastic force of the elastic member 201K so that the retardation gear member 121C of the third power transmission member 120C is separated from the retardation gear member 121K of the fourth power transmission member 120K. Under this circumstance, if the fourth photosensitive body 111K is rotated by a set angle and then the cam member 203K is rotated in the opposite direction as shown in FIG. 6B, the idle roller gear 204K again connects the third and the fourth retardation gear members 121C, 121K so that the third and the fourth retardation gear members 121C, 121K can be rotated in association with each other. By this principle, the two photosensitive bodies 111C, 111K can be rotated in association with each other. Likewise, the other photosensitive bodies 111Y, 111M can be rotated in association with each other to conform the rotation speed cycles with each other. FIG. 7 is a view of the change of the rotation speed cycle of the two photosensitive bodies according to the synchronization of the two photosensitive bodies.

As shown in the waveform view of FIG. 7, the plurality of the photosensitive bodies are synchronized by the color registration compensation unit so that color registration is enhanced.

Figure 8:
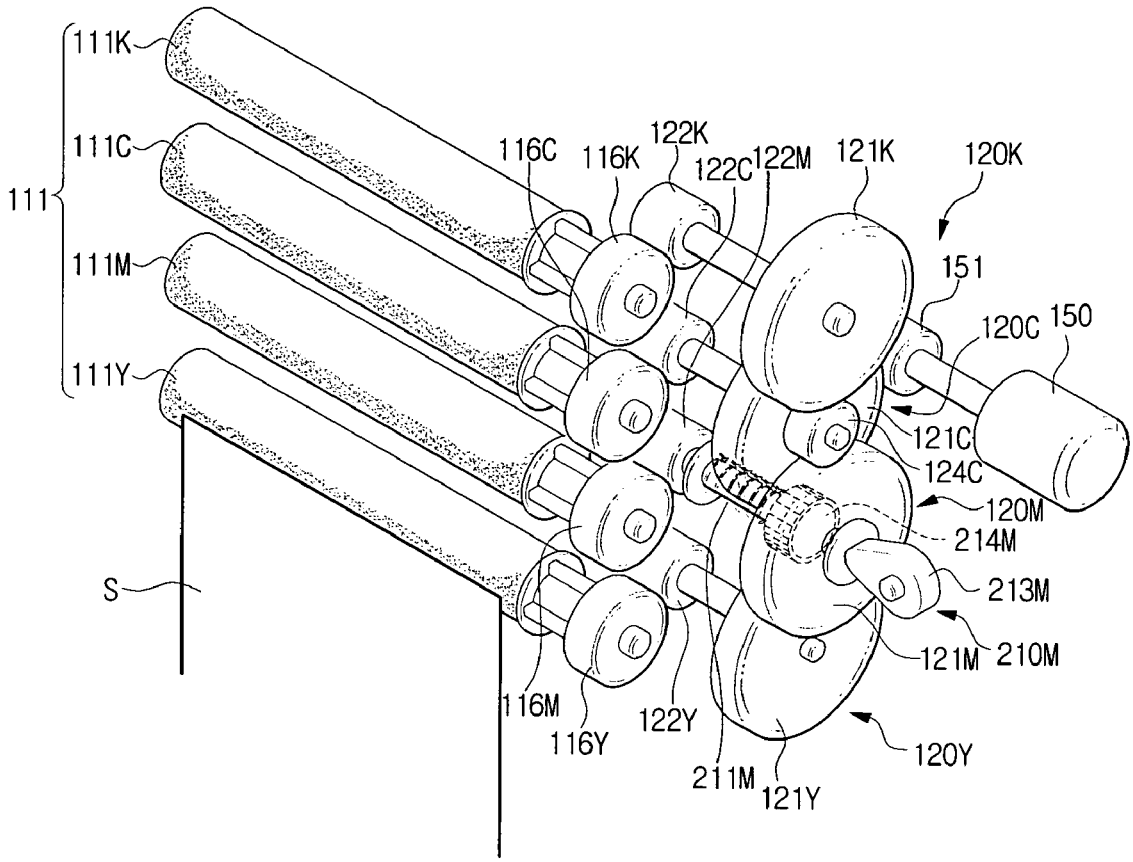
FIG. 8 is a perspective view of a portion of a color image forming apparatus according to a second exemplary embodiment of the present invention.

A color image forming apparatus according to the second exemplary embodiment of the present invention will now be explained in detail. FIG. 8 is a perspective view of a part of the color image forming apparatus according to the second exemplary embodiment of the present invention, and FIG. 9 is a front view of the color image forming apparatus of FIG. 8.

Figure 9:
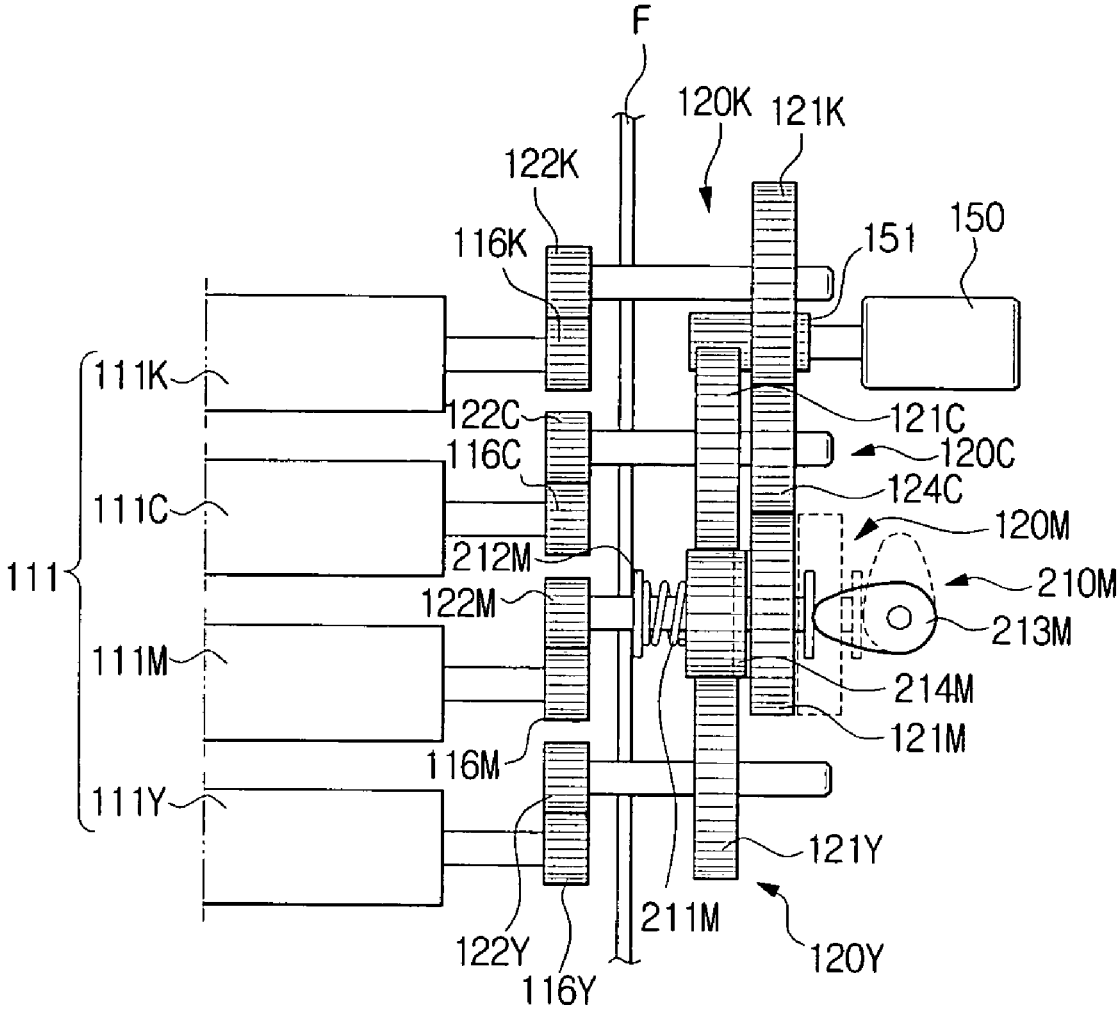
FIG. 9 is a front view of the color image forming apparatus of FIG. 8.

Referring to FIGS. 8 and 9, the color image forming apparatus according to the second exemplary embodiment of the present invention comprises a plurality of photosensitive bodies 111Y, 111M, 111C, 111K, a plurality of power transmission members 120Y, 120M, 120C, 120K and a color registration compensation unit 210M. The color image forming apparatus according to the second exemplary embodiment of the present invention has two photosensitive bodies 111C, 111K which are simultaneously driven by one driving source 150. In the drawings, the retardation gear members 121C, 121K of the neighboring third and the fourth power transmission members 120C, 120K, adjacent to the driving gear 151 of the one driving source 150, are meshed with each other so that the driving force can be simultaneously transmitted to the two photosensitive bodies 111C, 111K.

The plurality of the photosensitive bodies 111Y, 111M, 111C, 111K have the same structure as those according to the first exemplary embodiment of the present invention.

The power transmission members 120Y, 120M, 120C, 120K comprise the retardation gear members 121Y, 121M, 121C, 121K and the transmission gear members 122Y, 122M, 122C, 122K, respectively. The retardation gear members 121Y, 121M, 121C, 121K can reduce the frequency of rotation of the driving source 150 because the diameters of the retardation gear members 121Y, 121M, 121C, 121K is greater than that of the driving gear 151 of the driving source 150. The transmission gear members 122Y, 122M, 122C, 122K are coaxially engaged with the retardation gear members 121Y, 121M, 121C, 121K, respectively, based on the same shaft. The transmission gear members 122Y, 122M, 122C, 122K engage the shaft gears 116Y, 116M, 116C, 116K. The idle roller gears 214M, 124C are engaged with the second and the third power transmission members 120M, 120C among the power transmission members 120Y, 120M, 120C, 120K. Accordingly, among the power transmission members 120Y, 120M, 120C, 120K, the first and the third power transmission members 120Y, 120M are together driven by the idle roller gear 214M and the second and the fourth power transmission members 120M, 120K are together driven by the idle roller gear 124C. With this structure, the space required for installation is reduced since the neighboring retardation gear members 121Y, 121M, 121C, 121K can be overlapped.

A color registration compensation unit may be formed on at least one of the power transmission members. In the illustrated embodiment, a color registration compensation unit 210M is formed on the power transmission member 121M corresponding to, for example, magenta.

The color registration compensation unit 210M comprises an elastic member 211M and a cam member 213M. The elastic member has a first end and a second end. The first end of the elastic member 211M is fixed on the supporting frame F, and on the second end engages an idle roller gear 214M. A washer 212M may be placed between the first end of the first elastic member and the supporting frame F. The cam member 213M contacts the idle roller gear 214M, and the idle roller gear 214M can be moved in an axial direction of the second photosensitive body 111M according to the rotation of the cam member 213M. In the color image forming apparatus according to the second exemplary embodiment of the present invention, the idle roller gear 214M of the color registration compensation unit is formed on the same shaft as that of the second power transmission member 121M. The color registration compensation unit 210M may be formed on the third power transmission member 120C. In that case, the elastic member may be disposed at the opposite side of the frame or may be a tension spring to move the idle roller gear 124C.

The second exemplary embodiment of a color image forming apparatus operates the color registration compensation unit to synchronize the photosensitive body by using the same method as the color image forming apparatus according to the first exemplary embodiment of the present invention. Therefore, a detailed description of the operation will not be repeated.

Figure 10:
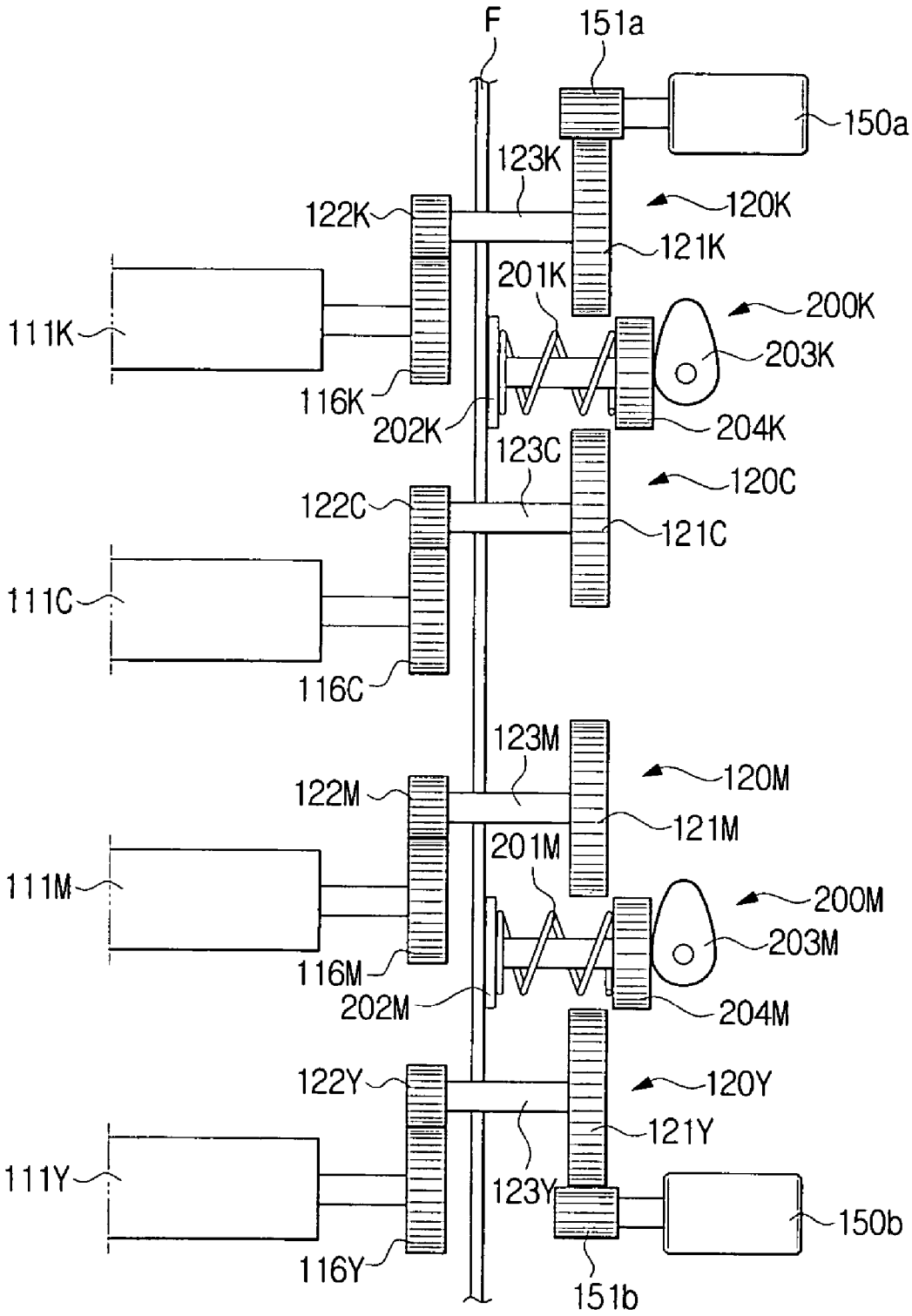
FIG. 10 is a front view of a portion of a color image forming apparatus according to a third exemplary embodiment of the present invention.

The color image forming apparatus according to exemplary embodiments of the present invention is not limited to apparatuses with only one driving source to drive a plurality of photosensitive bodies. In other words, the principles of the present invention can also be used with a color image forming apparatus in which at least two driving sources are provided and at least two power transmission members are together driven by the driving sources. FIG. 10 is a front view of a portion of a color image forming apparatus according to the third exemplary embodiment of the present invention, in which a plurality of photosensitive bodies are driven by two driving sources 150*a*, 150*b*. The color image forming apparatus has the same structure as the apparatus of FIG. 5, according to the first exemplary embodiment of the present invention, except for having the two driving sources. Therefore, a detailed description of common elements will not be repeated.

Referring to FIG. 10, the color image forming apparatus according to the third exemplary embodiment of the present invention comprises a plurality of photosensitive bodies 111Y, 111M, 111C, 111K, power transmission members 120Y, 120M, 120C, 120K and color registration compensation units 200M, 200K. Two photosensitive bodies 111Y, 111K are simultaneously driven by two driving sources 150*a*, 150*b*.

Each retardation gear member 121Y, 121K of the first and the fourth power transmission members 120Y, 120K is meshed with each driving gear 151*a*, 151*b* of the driving sources 150*a*, 150*b* so that the driving force can be simultaneously transmitted to the two photosensitive bodies 111Y, 111K. At this time, the two driving sources 150*a*, 150*b* must be synchronized and driven at the same speed. The synchronization can be easily performed by a conventional algorithm.

The color image forming apparatus according to the third exemplary embodiment of the present invention may have color registration compensation units 200M, 200K between a pair of power transmission members, that is, between 120Y and 120M, and between 120C and 120K. The plurality of photosensitive bodies of the color image forming apparatus according to the third exemplary embodiment of the present invention may be slightly more easily synchronized as compared with the color image forming apparatus according to the first and the second exemplary embodiments of the present invention.

A color image forming apparatus according to exemplary embodiments of the present invention can easily compensate for registration errors by the operation of the color registration compensation unit so as to enhance color image quality. The color registration errors include those caused by runout of the shaft gears of the photosensitive body as each photosensitive body is operated by one or more driving source.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A color image forming apparatus comprising:

a plurality of photosensitive bodies driven by a single driving source, each of the plurality of photosensitive bodies having a shaft gear;

a plurality of power transmission members engaged with the shaft gears of the plurality of the photosensitive bodies to transmit a driving force generated by the driving source to each of the plurality of the photosensitive bodies; and at least one color registration compensation unit disposed between the plurality of power transmission members and selectively compensating registration of respective ones of the photosensitive bodies.

2. A color image forming apparatus comprising:

a plurality of photosensitive bodies driven by a single driving source, each of the plurality of photosensitive bodies having a shaft gear;

a plurality of power transmission members engaged with the shaft gears of the plurality of the photosensitive bodies to transmit a driving force generated by the driving source to each of the plurality of the photosensitive bodies; and at least one color registration compensation unit disposed between the plurality of power transmission members;

wherein the color registration compensation unit comprises:

an elastic member with a first end and a second end, the first end of the elastic member being disposed on a supporting frame and the second end engaging an idle roller gear; and a cam member contacting the idle roller gear to move the idle roller gear in an axial direction of the photosensitive body.

3. The apparatus according to claim 2, further comprising a transfer unit opposed to the plurality of photosensitive bodies.

4. The apparatus according to claim 3, wherein the transfer unit comprises:

a plurality of transfer rollers arranged to oppose each of the plurality of photosensitive bodies; and a transfer belt passing between the plurality of the transfer rollers and the plurality of photosensitive bodies.

5. The apparatus according to claim 3, wherein as a paper passes between the plurality of photosensitive bodies and the transfer unit, toner images formed on the plurality of photosensitive bodies are directly transferred onto the paper.

6. The apparatus according to claim 3, wherein the transfer unit comprises:

a plurality of intermediate transfer rollers arranged to oppose each of the plurality of photosensitive bodies;

an intermediate transfer belt passing between the plurality of the intermediate transfer rollers and the plurality of photosensitive bodies; and a transfer roller for transferring toner images from the intermediate transfer belt onto the paper.

7. The apparatus according to claim 2, wherein a driving gear of the one driving source is meshed with one power transmission member so as to transmit the driving force to the plurality of the photosensitive bodies.

8. The apparatus according to claim 2, wherein the color registration compensation unit selectively blocks the transmission of the driving force to the photosensitive body.

9. The apparatus according to claim 2, wherein a power transmission member comprises:

a retardation gear member having a greater diameter than a driving gear of the driving source; and a transmission gear member coaxially engaged with the retardation gear member to transmit the driving force to each of the plurality of photosensitive bodies.

10. A color image forming apparatus comprising:

a plurality of photosensitive bodies driven by a single driving source, each of the plurality of photosensitive bodies having a shaft gear;

a plurality of power transmission members engaged with the shaft gears of the plurality of photosensitive bodies to transmit a driving force generated by the driving source to each of the plurality of photosensitive bodies; and a color registration compensation unit, formed on at least one of the power transmission members, and selectively compensating registration of respective ones of the photosensitive bodies.

11. The apparatus according to claim 10, wherein a driving gear of the one driving source is meshed with two neighboring power transmission members to transmit the driving force to the plurality of photosensitive bodies.

12. The apparatus according to claim 10, wherein the color registration compensation unit comprises:

an elastic member with a first end and a second end, the first end of the elastic member being disposed on a supporting frame and the second end engaging an idle roller gear; and a cam member contacting the idle roller gear to move the idle roller gear in an axial direction of the photosensitive body.

13. The apparatus according to claim 12, wherein the idle roller gear which the elastic member is disposed on also operates as an idle roller gear of the power transmission member.

14. The apparatus according to claim 10, wherein the color registration compensation unit selectively blocks the transmission of the driving force to the photosensitive body.

15. The apparatus according to claim 10, wherein the power transmission member comprises:

a retardation gear member having a greater diameter than a driving gear of the driving source; and a transmission gear member coaxially engaged with the retardation gear member to transmit the driving force to each of the plurality of photosensitive bodies.

16. The apparatus according to claim 15, wherein the power transmission member further comprises an idle roller gear disposed between non-neighboring retardation gear members to mesh the non-neighboring retardation gear members with each other.

17. The apparatus according to claim 15, wherein the neighboring retardation gear members overlap each other.

18. A color image forming apparatus comprising:

a plurality of photosensitive bodies driven by at least two driving sources, each of the plurality of photosensitive bodies having a shaft gear;

a plurality of power transmission members engaged with the shaft gears of the plurality of photosensitive bodies to transmit a driving force generated by the driving sources to each of the plurality of photosensitive bodies; and at least one color registration compensation unit disposed between the plurality of power transmission members;

wherein the color registration compensation unit comprises:

an elastic member with a first end and a second end; the first end of the elastic member being disposed on a supporting frame and the second end engaging an idle roller gear; and a cam member contacting the idle roller gear to move the idle roller gear in an axial direction of the photosensitive body.

19. The apparatus according to claim 18, wherein the at least two driving sources are synchronized and driven at the same speed.

20. The apparatus according to claim 18, wherein the power transmission member comprises:

a retardation gear member having a greater diameter than a driving gear of each of the driving sources; and a transmission gear member coaxially engaged with the retardation gear member to transmit the driving force to each of the plurality of photosensitive bodies.

21. The apparatus according to claim 18, wherein the color registration compensation unit selectively blocks the transmission of the driving force to the photosensitive body.

* * * * *